US006173636B1

(12) United States Patent
Madrzak et al.

(10) Patent No.: US 6,173,636 B1
(45) **Date of Patent: *Jan. 16, 2001**

(54) TRAVELING FIBER MATERIAL WEB CUTOFF APPARATUS

(75) Inventors: Zygmunt Madrzak; Bernd Kaufmann, both of Heidenheim (DE)

(73) Assignee: Voith Sulzer Papiermaschinen GmbH, Heidenheim (DE)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/838,147

(22) Filed: Apr. 15, 1997

(30) Foreign Application Priority Data

Apr. 19, 1996 (DE) ..... 196 15 370

(51) Int. Cl.[7] ..... B26D 5/08

(52) U.S. Cl. ..... 83/601; 83/424; 83/436.1; 83/649; 83/949

(58) Field of Search ..... 83/62, 98, 106, 83/152, 276, 453, 620, 639.4, 654, 586, 597, 650, 948, 639.1, 639.2, 639.3, 601, 424, 436.1, 649, 949

(56) References Cited

U.S. PATENT DOCUMENTS 3,591,279 * 7/1971 Gardner ..... 83/106
3,702,086 * 11/1972 Moss ..... 83/152
3,717,057 * 2/1973 Takimoto ..... 83/152
3,770,551 * 11/1973 Ceroll ..... 83/276
3,847,046 * 11/1974 Schmermund ..... 83/152
3,854,357 * 12/1974 Kron ..... 83/106
3,976,237 * 8/1976 Bossons ..... 83/98
4,056,024 * 11/1977 Baert et al. ..... 83/62
4,094,727 * 6/1978 Collins ..... 83/453
4,907,014 3/1990 Tzeng et al. ..... 346/24
4,936,942 6/1990 Sollinger et al. ..... 156/504
5,146,829 * 9/1992 Wadzinski ..... 83/620

* cited by examiner

*Primary Examiner*—Rinaldi I. Rada
*Assistant Examiner*—Melissa L. Hall
(74) *Attorney, Agent, or Firm*—Taylor & Aust, P.C.

(57) ABSTRACT

A paper machine for one of making and processing a fiber material web. A plurality of rolls carry the fiber material web. The plurality of rolls include a load roll and another roll defining a nip therebetween. The fiber material web travels through the nip and defines a gore with the load roll on an approach side of the nip. A movable cutoff knife includes a cutting edge positioned in the gore at a slight distance from the nip and adjacent to the fiber material web. At least one impulse exchanger is positioned in association with the cutoff knife. The impulse exchanger is configured to transfer impulse energy to the cutoff knife whereby the cutting edge cuts the fiber material web.

9 Claims, 4 Drawing Sheets

TRAVELING FIBER MATERIAL WEB CUTOFF APPARATUS

BACKGROUND OF THE INVENTION

1. Field of the Invention

The present invention relates to an apparatus for the cutoff of a fiber material web, such as a web for paper or cardboard, in a paper machine such as a paper-making machine, rewinder, coater and/or rotary slitter.

2. Description of the Related Art

A cutoff apparatus as described above may be configured with a machinewide knife that extends transverse to the direction of paper travel (see, e.g., DE 38 15 277). The cutting edge of the knife according to DE 38 15 277 has a large distance from the impact point of the cutting edge to the splice on the splicing roll. As a result, an excessively long paper remnant, or paper tail, remains behind the splice after cutoff of the material web and gluing it to a new web. This leads to breaks, for example in a follow-on coater, notably with thin paper grades. Furthermore, the apparatus according to DE 38 15 227 has the further disadvantage that a serrated blade is used, as a result of which the web undesirably has a serrated cutoff edge.

DE-U-94 13 363 shows an apparatus for cutoff of a traveling material web. The apparatus is equipped with a cutoff knife heavily slanted opposite to the direction of web travel and avoids the latter of the aforementioned disadvantages. The angle occurring during the cutoff process between cutoff knife and material web is with the object according to DE-U-94 13 363 smaller than 45 degrees. At low web velocities, a cutoff edge which is extensively straight across the material web can be achieved with it, but, especially with high web velocities, >1500 m/min, the measures according to DE-U-94 13 363 are no longer sufficient to achieve the desired reliability of operation. A factor in addition to the known problems with the above high web velocities is that the cutoff velocity of the cutoff knife is mostly insufficient to achieve a non-serrated cutoff.

What is needed in the art is a cutoff apparatus which overcomes the disadvantages that occur at high web velocities with the prior-art apparatuses.

SUMMARY OF THE INVENTION

According to a first embodiment, the cutting edge of the knife disposed underneath the material web is in the inoperative position located in the gore between the paper web and a load roll, spaced slightly from a nip formed by the load roll and a roll. This creates the advantage that the material web remnant which after web cutoff enters the nip, e.g., a splicing nip, is very short.

The invention provides for coordinating with the cutoff knife an actuator that comprises at least one impulse exchanger. Achieved with the use of such actuator, as compared to the actuators known heretofore, is the advantage of a non-serrated cutoff at very high web velocities.

According to the invention, the impulse exchange may take place mechanically or pneumatically. The impulse exchanger produces a collision, or impulse exchange, between two masses. As is evident from the following formula for a mechanical impulse generator, it is especially advantageous for the mass of the cutoff knife to be very slight, $$V_2 = \frac{2m_1 \times V_1}{m_1 + m_2}$$

where $V_2$ is the velocity of the cutoff knife with the mass $m_2$ after the collision, and $V_1$ is the velocity of the striking mass $m_1$. With $m_2$ being much smaller than $m_1$, all that can be achieved in the most favorable case is a cutoff knife velocity twice as high as the velocity of the striking mass.

As mentioned already above, a pneumatic impulse generator may also be employed; it uses a directional flow—for example compressed air—that is directed at the cutoff knife and accelerates it by exchange of the flow impulse.

Moreover, the acceleration of the cutoff knife can be aided when the actuator features in addition to the described impulse generators an energy store, for example a spring or store of compressed air. The energy stored in these systems is upon knife actuation released abruptly and converted to kinetic energy of the cutoff knife.

Of particular advantage is slanting the cutoff knife opposite to the direction of web travel. A preferred embodiment provides for the angle created in the cutoff process between the cutoff knife and the material web to be less than 45 degrees. The slanting of the cutoff knife shortens the cutoff times further still as compared to prior solutions, so that the material web cutoff proceeds very quickly. For example, an escape of the web and, thus, the tendency of wrinkling is nearly precluded.

Another embodiment provides for optimally adjusting to one another, with respect to a non-serrated cutoff, the factors that influence the cutoff edge, such as the angle forming during the cutoff process between the cutoff knife and the material web, the velocity of the material web and the approach velocity of the cutoff knife.

With the present invention, the cutoff knife is by impulse exchange accelerated such that the traveling material web is being cut off at a high cutoff knife velocity.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
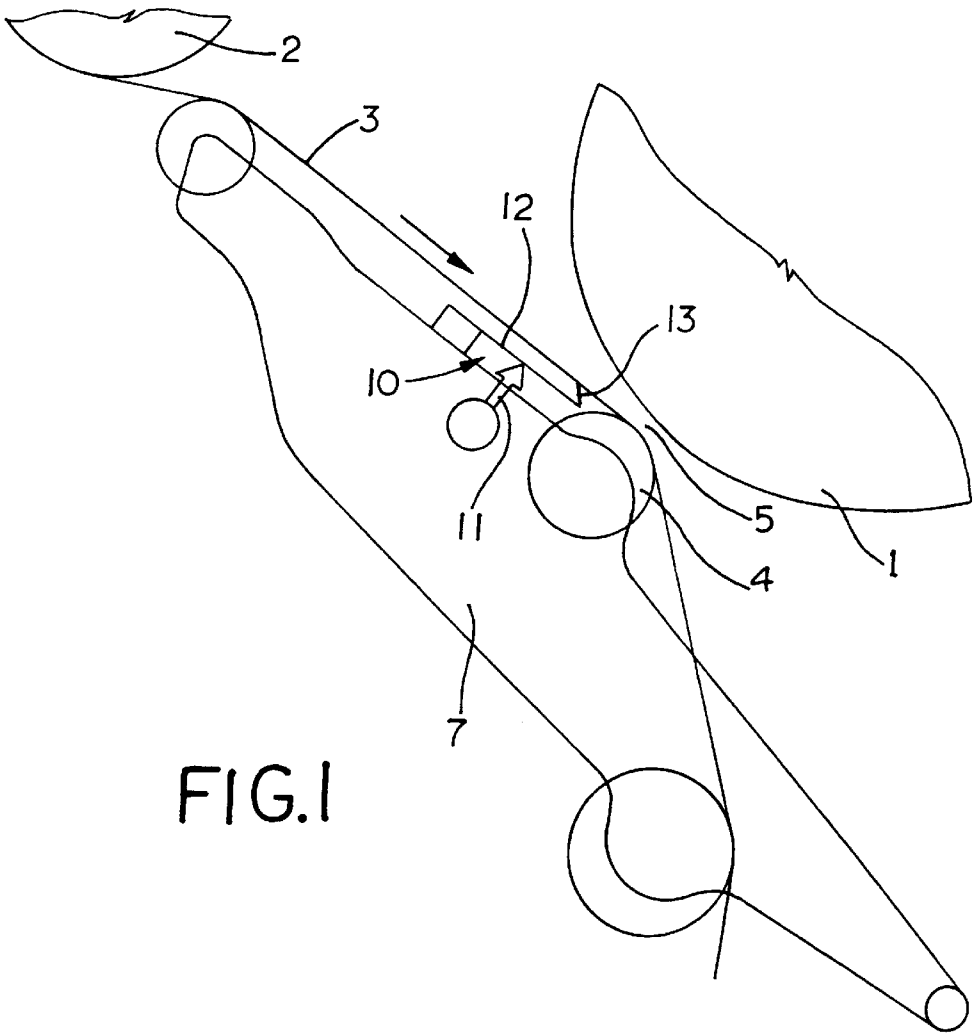
FIG. 1 is a schematic illustration of one embodiment of a cutoff apparatus of the present invention in a gore between the fiber material web and a load roll, a slight distance from a nip formed by the load roll and another roll.

FIG. 1 shows an embodiment of the cutoff apparatus 10 of the present invention including a cutoff knife 12 in a splicer intended for use in coaters. The splicer includes a new paper roll 1 and an old paper roll 2 from which is unwinding a depleting fiber material web in the form of a paper web 3. In splicing the end of web 3 to the leader of new paper roll 1, the splicer is moved toward roll 1. A nip or splicing point 5 is created between the load roll 4 and the new paper roll 1, where the end of the old web 3 is glued to the leader of the new web from new paper roll 1. Disposed on the approach side and directly before load roll 4 is a cutoff apparatus 10, which in the present case is equipped with a cutoff knife 12 and an impulse exchanger 11. The cutoff knife 12 has a cutting edge 13 that is slanted opposite to the direction of web travel. This arrangement of the cutoff apparatus 10 in the gore between roll 1 and load roll 4, spaced slightly relative to the splicing point 5, achieves that the old paper web remnant entering the nip upon cutoff of the paper web 3 is only short.

Owing to the illustrated design of the cutoff apparatus, moreover, the cutoff operation does not cause a liftoff of the web, thereby avoiding with the present invention the web stabilizers, such as suction boxes arranged in prior-art designs before the splice.

Figure 2:
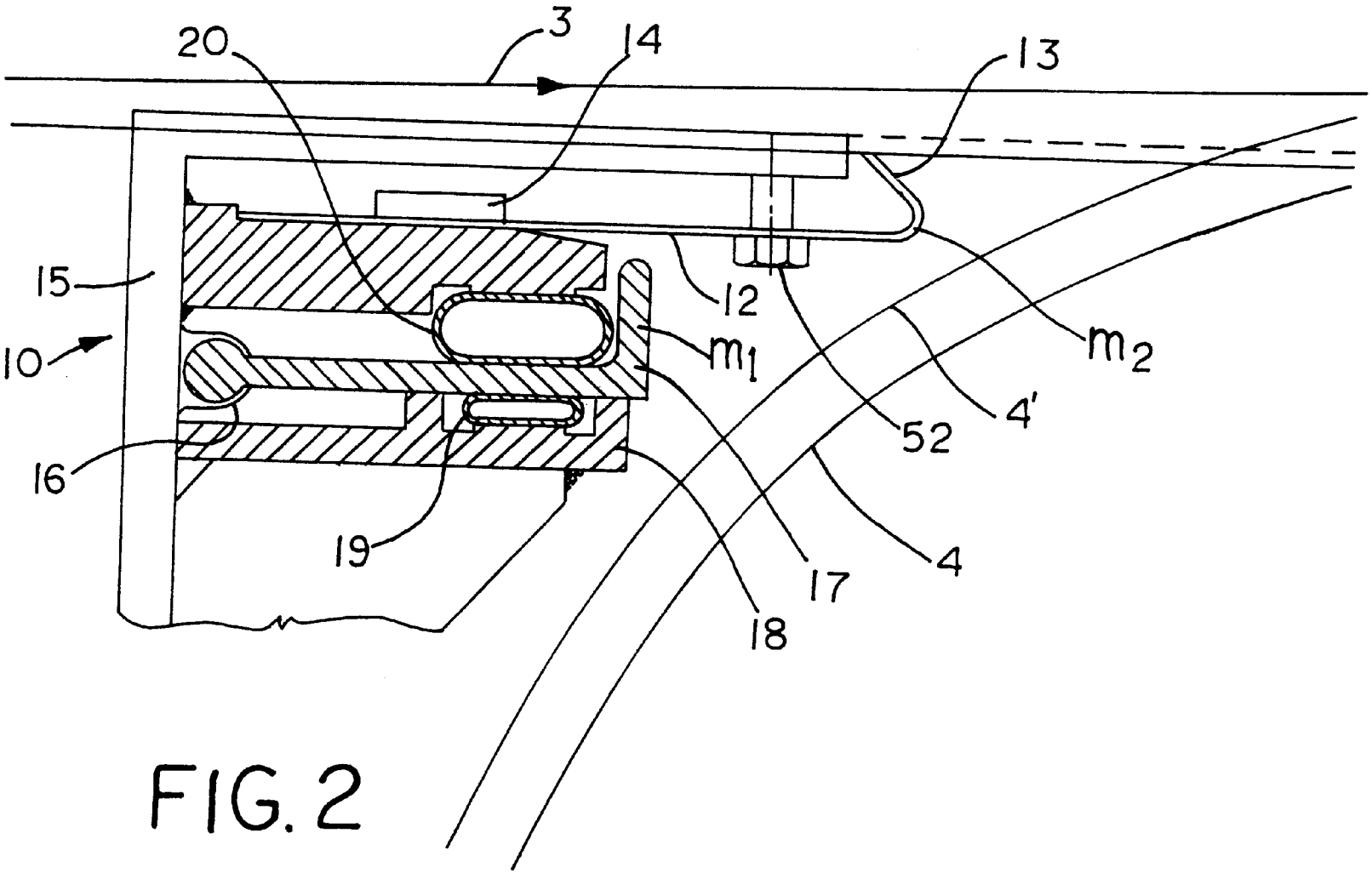
FIG. 2 is a more detailed illustration of the cutoff apparatus shown in FIG. 1.

FIG. 2 shows the inventional apparatus relative to FIG. 1 in more detail. Similar to the arrangement according to FIG. 1, the cutoff apparatus 10 is disposed in the gore underneath the paper web 3 near the load roll 4. Cutoff knife 12 includes a cutting edge 13 which is slanted opposite to the direction of web travel and mounted in a clamp 14. The part of cutoff knife 12 that is not clamped in place is movable in vertical direction under the effect of bending forces. Clamp 14 is secured to a support arm 15 of cutoff apparatus 10. Below clamp 14, a mechanical impulse generator 17 is mounted pivotably on the support arm 15 in a bearing 16. The mechanical impulse generator 17 mounted pivotably, or rotatably, in the bearing 16 is retained elastically, by clamping effect, between the underside of clamp 14 and a prop 18, by means of two deformable elements, for example, elastic compressed-air hoses 19 and 20. When now inflating the lower compressed-air hose 19 and deflating the upper compressed-air hose 20, the mechanical impulse generator 17 pivots about the axis of bearing 16 and makes contact with the bottom edge of the cutoff knife 12. In the process, an impulse exchange takes place from the mechanical impulse generator to the cutoff knife. The mounted cutoff knife 12 accelerates toward the paper web and cuts it off. The knife 12 being clamped in the clamp 14, it retracts to the illustrated starting position under the recoil force that results from the clamping of the blade. A stop 52 prevents the knife from overshooting in the direction of the mechanical impulse generator 17. In splicing the old web to the new one, the splicing or load roll 4 is located in the deployed splicing position 4' depicted.

Figure 3:
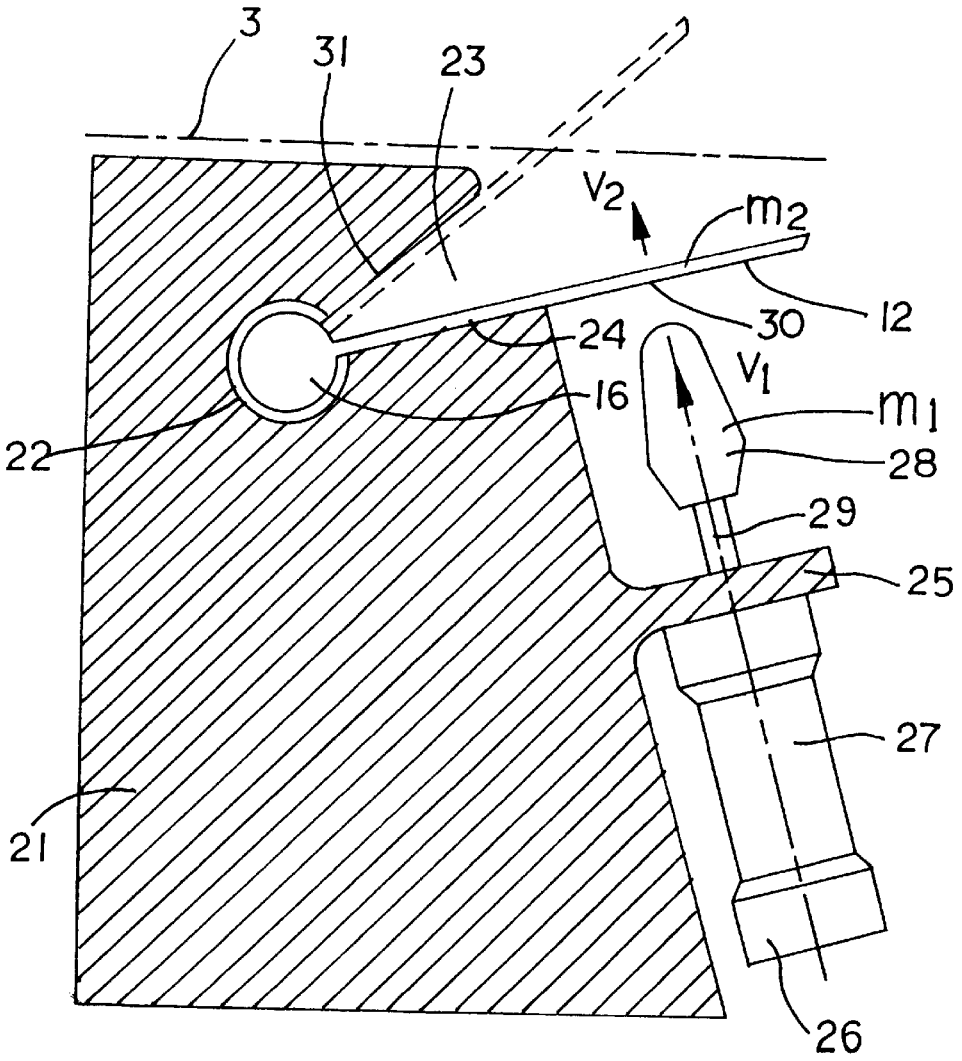
FIG. 3 illustrates another embodiment of a cutoff apparatus of the present invention including a cutoff knife and a mechanical impulse generator as an actuator.
Figure 4:
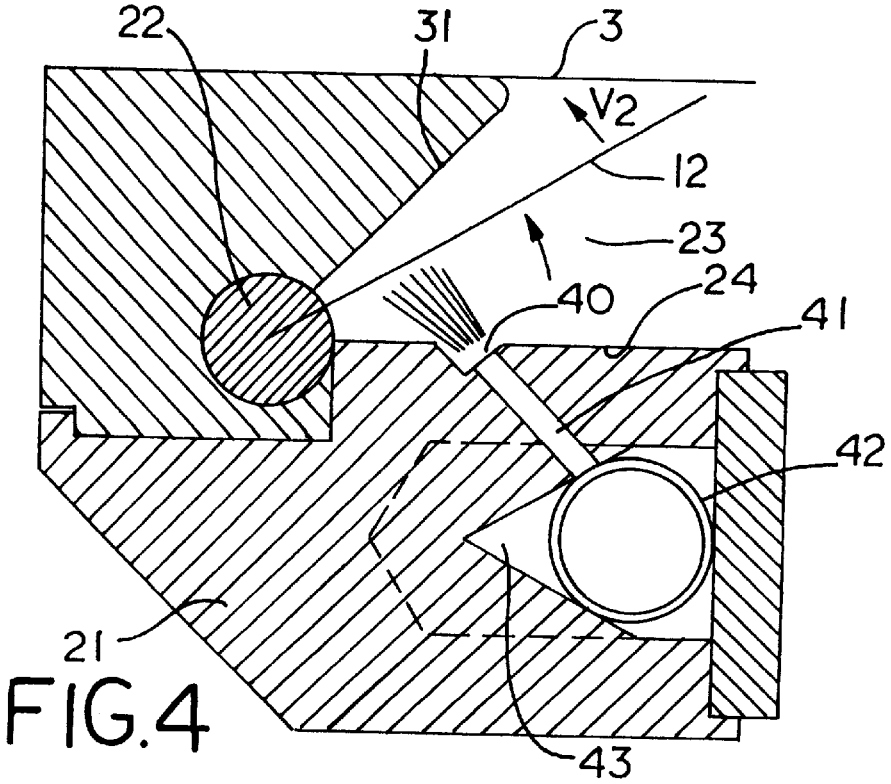
FIG. 4 illustrates yet another embodiment of a cutoff apparatus of the present invention including a cutoff knife and a non-mechanical impulse generator as an actuator.
Figure 5:
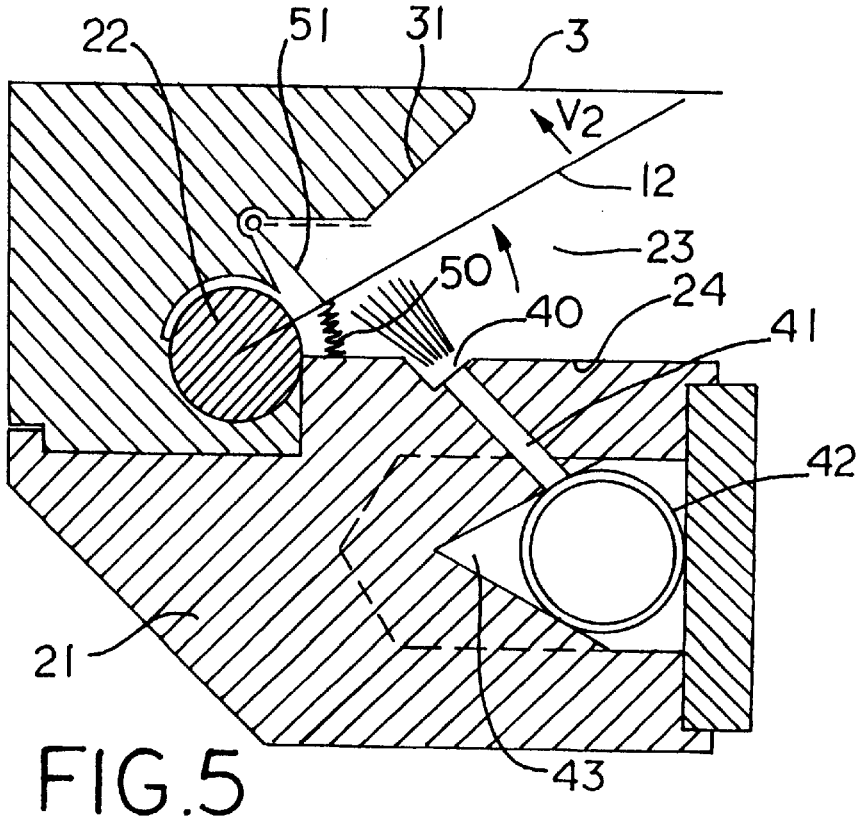
FIG. 5 illustrates still another embodiment of a cutoff apparatus of the present invention including a cutoff knife, an impulse generator and an energy store.

Further embodiments of a mechanical impulse generator (refer to FIG. 3) and of a pneumatic impulse generator are illustrated schematically in FIGS. 4 and 5. According to FIG. 3, the cutoff knife 12 is mounted rotatably in a massive bearing block 21. Massive bearing block 21 includes a round bearing bore 22 that receives the bearing 16 of the cutoff knife 12. Bordering on the bearing bore 22 is a V-shaped recess 23 formed in bearing block 21. In its inoperative position, knife 12 rests on the bottom edge 24 of V-shaped recess 23. Mounted on the massive bearing block 21, by means of a holder 25, is a mechanical impulse generator 26. Mechanical impulse generator 26 includes, e.g., a cylinder assembly 27, which can be operated by compressed air or hydraulics and includes a plunger 28 of a mass $m_1$, attached to a plunger rod 29 fitted in cylinder assembly 27. When actuating cutoff knife 12, cylinder assembly 27 is actuated out of its illustrated inoperative position, and the mass $m_1$ of plunger 28 accelerates to the velocity $V_1$, at which it impinges at point 30 on the inoperative, rotatably mounted cutoff knife.

The preferably dead jolt transfers the impulse of mass $m_1$ virtually entirely to the movable mass of cutoff knife 12 having a mass $m_2$ which is accelerated to a velocity $V_2$ and moves about the bearing axis to the dashed position, cutting the paper web 3 off in the process. The rotary motion of cutoff knife 12 is limited by the top edge 31 of V-shaped recess 23. With the paper web 3 cut off, the cutoff knife 12 proceeds by reset forces, e,g., by gravity, to its starting position, in which the cutoff knife rests on the bottom edge 24 of V-shaped recess 23, and the plunger 28 retracts to its indicated starting, or inoperative position.

FIG. 4 shows another exemplary embodiment of an inventional cutoff knife with a pneumatic impulse generator. As in the case of FIG. 3, the cutoff knife 12 is mounted rotatably in a bearing 22 in a massive bearing block 21. The same as in FIG. 3, bearing block 21 has a V-shaped recess 23. Several orifices 40 of a nozzle assembly are arranged successively in the underside 24 the V-shaped recess 23 in the bearing block 21. Orifices 40 connect via ducts 41 to a pressure chamber 43 provided in the bearing block 21, in which chamber rests a compressed-air hose 42. In its inoperative position, cutoff knife 12 bears on bottom edge 24 of V-shaped recess 23. In actuating the knife, compressed air released from compressed-air hose 42 flows from the compressed-air chamber 43 through duct 41 to the orifices 40. The impulse carried along by the flow actuates the cutoff knife 12 and accelerates it to a velocity $V_2$, thereby cutting the paper web 3 off. The rotary motion of knife 12 is limited by the top edge 31 of the V-shaped recess 23, the same as in FIG. 3.

Instead of using a compressed-air hose 42, valves (not illustrated in FIG. 4) may initiate the flow out of the compressed-air chamber 43. To that end, the valves are suitably integrated in the ducts 41.

In accordance with the embodiment illustrated in FIG. 5, it is optionally also possible to combine an energy storage apparatus, or energy storage system, with an impulse exchanger according to, e.g., FIG. 3 or FIG. 4. According to FIG. 5, a spring 50 serves as an energy store. Conceivable would be also other energy stores, such as inflated elastic compressed-air hoses. Spring 50 is in a compressed state when the cutoff knife, as illustrated, assumes its inoperative position. In order for cutoff knife 12 not to be actuated unintendedly by the energy stored in the spring, cutoff knife 12 is fixed in the illustrated position by a holddown 51. Upon release of holddown 51, cutoff knife 12 is in synchronism acted upon by a flow impulse while the holddown 51 pivots to the position shown by a dashed line, thereby abruptly releasing the energy stored in spring 50 and accelerating cutoff knife 12 in addition to the impulse exchange from orifices 40.

The present invention thus makes it for the first time possible to achieve also in the case of material webs traveling at high speed a flawless cutoff the of the paper web, thereby preventing difficulties in subsequent processing, for example, in a splicer or coater.

What is claimed is:

1. A paper machine for one of making and processing a fiber material web, said paper machine comprising:

a plurality of rolls carrying the fiber material web, said plurality of rolls including a load roll and another roll defining a nip therebetween, the fiber material web traveling through said nip and defining a gore with said load roll on an approach side of said nip;

a movable cutoff knife including a cutting edge positioned in said gore at a slight distance from said nip and adjacent to the fiber material web; and at least one impulse exchanger positioned in association with said cutoff knife, each said impulse exchanger being configured to transfer impulse energy to said cutoff knife to accelerate said cutting edge into colliding and thereby cutting contact with the traveling fiber material web, each said impulse exchanger being an impulse generator configured for transferring said impulse energy by impact of a striking force against said cutoff knife.

2. The paper machine of claim 1, wherein said cutting edge of said cutoff knife is slanted toward the fiber material web in a direction generally opposite to the direction of travel of the fiber material web.

3. The paper machine of claim 2, wherein said cutting edge of said cutoff knife is slanted at an angle of less than approximately 45 degrees relative to the traveling fiber material web during said cutting of the fiber material web.

4. The paper machine of claim 3, wherein said angle of said cutoff knife relative to the material web, a traveling velocity of the material web, and a velocity of said cutoff knife when the material web is cut coact such that the material web is cut in an approximately straight line.

5. The paper machine of claim 1, wherein said paper machine comprises one of a paper-making machine, rewinder, coater and rotary slitter.

6. The paper machine of claim 1, wherein said cutting edge is positioned below the fiber material web.

7. The paper machine of claim 1, wherein said another roll comprises a new paper roll.

8. A paper machine for one of making and processing a fiber material web, said paper machine comprising:

a plurality of rolls carrying the fiber material web, said plurality of rolls including a load roll and another roll defining a nip therebetween, the fiber material web traveling through said nip and defining a gore with said load roll on an approach side of said nip:

a movable cutoff knife including a cutting edge positioned in said gore at a slight distance from said nip and adjacent to the fiber material web; and at least one impulse exchanger positioned in association with said cutoff knife, said at least one impulse exchanger configured to transfer impulse energy to said cutoff knife whereby said cutting edge cuts the traveling fiber material web, said at least one impulse exchanger comprising a mechanical impulse generator which transfers said impulse energy by impact of a striking mass against said cutoff knife.

9. The paper machine of claim 2, wherein said cutoff knife has a mass which is smaller than a mass of said striking mass.

* * * * *

UNITED STATES PATENT AND TRADEMARK OFFICE

CERTIFICATE OF CORRECTION

PATENT NO. : 6,173,636 B1
DATED : January 16, 2001
INVENTOR(S) : Zygmunt Madrzak et al.

It is certified that error appears in the above-identified patent and that said Letters Patent is hereby corrected as shown below:

Column 6,
Line 19, after "and" insert a new paragraph.
Line 28, delete "2" and substitute -- 8 -- therefor.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*